United States Patent [19]

Damour

[11] Patent Number: 4,862,565

[45] Date of Patent: Sep. 5, 1989

[54] SPREADER ROLL FOR WRINKLE-FREE TRAVELING WEB

[76] Inventor: Lawrence R. Damour, 16 Chesler Sq., Succasunna, N.J. 07876

[21] Appl. No.: 192,137

[22] Filed: May 10, 1988

[51] Int. Cl.[4] ..... D06C 3/06

[52] U.S. Cl. ..... 26/99

[58] Field of Search ..... 26/99, 100

[56] References Cited

U.S. PATENT DOCUMENTS 3,344,493 10/1967 Telgheider ..... 26/99

FOREIGN PATENT DOCUMENTS 158160 3/1957 Sweden ..... 26/99

545277 5/1942 United Kingdom ..... 26/99

*Primary Examiner*—Robert R. Mackey

*Attorney, Agent, or Firm*—Ralph R. Roberts; Patrick J. Pinto

[57] ABSTRACT

This invention pertains to a spreader roll adapted to remove wrinkles, ripples, bags and torque marks from fast-traveling webs of material of fabric, plastic or combinations thereof. The resulting fast-traveling web has a smooth, uninterrupted surface. This spreader roll is not a bowed or grooved roll, but is a straight roll having a resilient outer tubular rubber sleeve. The supporting shaft is straight, rigid, non-rotating, and is carried by support blocks. This outer sleeve is retained at each end by clamp means which is carried by anti-friction bearings. This clamp means includes a bearing ring which is pivotally carried by the central shaft. Each pivoted bearing ring is individually adjusted to stretch the resilient cover to remove the distorting wrinkles, ripples, bags or torque marks in the fast-moving web. A multiplicity of disc brushes is carried on a freely rotating tubular member and these brushes are positioned by spacer rings. The brushes accommodate the expansion and contraction of the resilient outer rubber sleeve.

17 Claims, 4 Drawing Sheets

SPREADER ROLL FOR WRINKLE-FREE TRAVELING WEB

BACKGROUND OF THE INVENTION

1. FIELD OF THE INVENTION

With respect to the classification of art as established in and by the United States Patent and Trademark Office, this invention is believed to be found in the general class entitled as "Textiles, Manufacturing," and more particularly, to a Spreader Roller to stretch the intermediate portion of a traveling web to remove wrinkles.

2. DESCRIPTION OF THE PRIOR ART

A careful pre-ex search was made in and of the art as exemplified by the United States Patents. U.S. Pat. No. 1,005,801, as issued to BIRCH on Oct. 17, 1911, showed or disclosed a brush-type of cloth stretching device. The brushes are in contact with the traveling web and there is no suggestion or teaching of a no-bow spreader roller. Also noted were U.S. Pat. No. 2,600,291 as issued to ENGLER on June 10 1952; U.S. Pat. No. 2,626,422 as issued to LAMMERTSE on Jan. 27, 1953; U.S. Pat. No. 3,060,545 as issued to THIEL et al on Oct. 30, 1962; U.S. Pat. No. 3,344,493 as issued to TELGHEIDER on Oct. 3, 1967; U.S. Pat. No. 3,543,365 as issued to HELMINEN on Dec. 1, 1970; U.S. Pat. No. 3,672,018 as issued to JUNK et al on June 27, 1972; U.S. Pat. No. 3,734,491 as issued to BERRY et al on May 22, 1973; U.S. Pat. No. 4,470,183 as issued to KUOSA on Sept. 11, 1984; and a bowed roller utilizing a cover was shown in U.S. Pat. No. 4,146,947 as issued to RICHTER on Apr. 3, 1979.

A very recently issued U.S. Pat. No. 4,692,971 to GINTER on Sept. 15, 1987 addressed the problem of removing wrinkles from a traveling web of flexible material, but this roller of GINTER anticipates sections 42, each of which are carried by two rows of ball bearings. The central support shaft 30 is bowed and is non-rotating, as in the applicants device, but does not provide the desired wrinkle removal in a traveling web. Curved rollers are well known and often have surfaces of steel or aluminum as segments, generally called spool assemblies, which are rotatably mounted on a curved axle. The opposite ends of the curved axle are clamped and are adjustable so that the curved axis of the axle may be set in any desired plane about a straight axis common to both end clamps.

These compensating rollers and the manner of adjustably supporting them, such that the curved axis of the axles thereof can be set in any desired plane, generally function satisfactorily in stretching or contracting webs crosswise of their length and in removing wrinkles from the webs traveling over them. In many cases, however, it is found that the opposite lateral edges of the web are wrinkled since the webs are not properly expanded or contracted along its edges. these wrinkled edges must be trimmed or otherwise removed. Doing so can create a substantial amount of waste.

The compensating rollers, as identified above, do not completely remove wrinkles, ripples, bags and torque marks from fast moving flexible webs, along a flat plane. The present invention is believed to provide such a device and perform in a positive manner.

SUMMARY OF THE INVENTION

This invention may be summarized, at least in part, with reference to its objects. It is an object of this invention to provide, and it does provide, a no-bow spreader roller that removes wrinkles, ripples, bags, torque marks and the like from fast moving traveling webs of material such as textiles and plastics. This compensating roller does not employ a curved or bowed roller, but instead employs a rigid, non-turning support shaft. The roller is comprised of a resilient tubular outer sleeve which is rotating at the same peripheral speed as the traveling web. This tubular sleeve member, usually made of rubber or elastermeric compounds thereof, is supported by a plurality of brushes, each carried by a hub on an inner tube member carried by anti-friction bearings mounted on the rigid shaft. This outer sleeve is tensioned by pivoted arms that are individually adjusted to accommodate the requirement conditions of the traveling web.

It is a further object of this invention to provide, and it does provide, a spreader roll in which the resilient cover member is tensioned and adjusted by and with pivoted lever means, each having an arm providing a lever end that is in engagement with the non-rotating shaft. Each lever means actuates an end member carried by an anti-friction bearing and the outer resilient cover is manipulated in response to the positioning of the lever.

In brief, this invention pertains to a spreader roll for fast-traveling webs, with the roller adapted to remove wrinkles, ripples, bags and torque marks from said webs. This roller has a straight, smooth, uninterrupted surface which is a resilient tube member. This roller may be supported and positioned to provide a minimum contact wrap to as much as a full wrap of one hundred eighty degrees. The roller is carried by a fixed shaft and, at each end, by support blocks. An adjustable and adjusted pivoted lever is provided at each end, with each lever having a bearing ring on which is mounted an anti-friction bearing which, in turn, carries retaining means for the resilient tubular outer sleeve. A multiplicity of brushes arrayed in disc style is carried on a tubular support which is carried by anti-friction bearings so that the exterior ends of the brushes may engage the interior diameter of the resilient sleeve and be rotated therewith. The brushes are spaced from each other by tubular spacers. The outer resilient roller portion is adjusted so that a determined spread of the traveling web may be achieved by the roller without a distortion of the web as with a curved roller.

This roller apparatus provides gentle expansion and/or contraction of the outer surface and promotes positive yet nondistorting wrinkle and sag removal. The fixed stretching provided by curved rollers or grooved rolls promotes web stretch at the center of the web but is not present in this novel roller as the ends of this roller can be and are adjusted so that differing spread characteristics are achieved. One edge, for example, may be adjusted for dramatic spreading while the other edge portion may have only a shallow wrinkle or two, requiring only light spreading action. This novel roll is contemplated for narrow webs as well as very wide webs.

In addition to the above summary, the following disclosure is detailed to insure adequacy and aid in understanding of the invention. This disclosure, however, is not intended to cover each new inventive concept no matter how it may later be disguised by variations in form or additions of further improvements. For this reason, there has been chosen a specific embodiment of a spreader roll for a wrinkle-free traveling web as adopted for use with fast-moving traveling webs of fabric, plastic and/or combinations thereof, and showing a preferred means for constructing the roll. This specific embodiment has been chosen for the purposes of illustration and description as shown in the accompanying drawings wherein:

BRIEF DESCRIPTION OF THE DRAWINGS

In the following description and in the claims, various details are identified by specific names for convenience. These names are intended to be generic in their application. Corresponding reference characters refer to like members throughout the several figures of the drawings.

Figure 1:
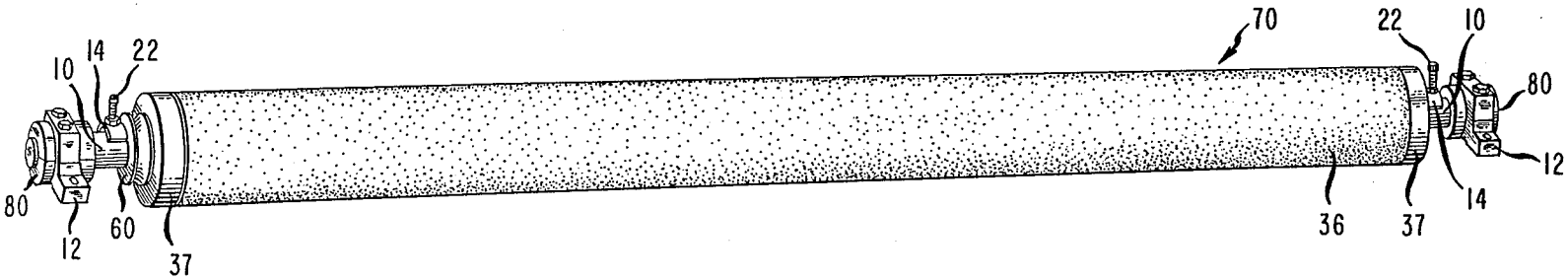
FIG. 1 represents a perspective view of the no-bow spreader roller apparatus in an assembled condition for installation in a customer's plant.

The drawings accompanying, and forming part of, this specification disclose details of construction for the purpose of explanation, but structural details may be modified without departure from the concept and principles of the invention and the invention may be incorporated in other structural forms than shown.

DESCRIPTION OF THE PREFERRED EMBODIMENT

This roller provides a no-bow spreader roll providing edge-to-edge adjustability while a fast-moving web is in motion. The roller is of a selected length to accommodate the width of the fast-traveling webs of material. The apparatus or frame/frames carrying the roller is conventionally provided with adjusting means so that the wrap of the web on the roller may be as little as light contact to as much as full contact of one hundred eighty degrees. As depicted, the roller construction includes a center shaft 10 which is shown as a tube having both ends machined to provide assured seating and retention in and by shaft support blocks 12. These blocks conventionally have extending pad portions in which are provided elongated holes 13 for mounting on frame apparatus (not shown). Inward of the blocks 12 is a pivoted lever, generally identified as 14.

Each end of the roller has a pivoted lever 14, with an extending leg 16 secured to and carrying a bearing ring 18. It is to be noted that this ring 18 is made with an enlarged bore 20 sufficient for adjustable positioning (tilting) of this ring without engagement with the shaft 10 which is non-rotating. Adjustment of the pivoted lever 14 is made by providing in the outer end 16 of the lever 14 a threaded hole in which a socket head screw 22 is mounted. A lock nut 23 is carried on the threaded shank of the screw so as to prevent unwanted turning of the screw after adjustment has been made. The inner end of screw 22 engages the outer surface of shaft 10. A pivot screw 24 or screws are utilized in the ring 18 and shaft 10 so that the pivot of the ring 18 on shaft 10 is very precise and no longitudinal movement of the ring 18 occurs in relation to the shaft 10.

On each bearing ring 18 is mounted an anti-friction bearing 26 which is illustrated as a ball bearing. This bearing carries an inner clamp ring 28 which may be made from and of aluminum tubing. This clamp ring 28 is not only configured to be a retaining fit on the bearing 26 with a stop shoulder shown, but also is provided with a plurality of threaded holes, each sized and adapted to receive and retain a flat head screw 32. This clamp ring 28 is also contoured to provide and form a clamp shoulder or the inner retaining portion of a clamping means when and as a sleeve clamp 34 is tightened around the periphery of an outer resilient sleeve 36 and securing the resilient sleeve 36 to the clamp ring 28 by a friction fit. Preferably this resilient sleeve is of a tubular configuration and made of rubber or similar elastomer compounds. A clamp cover 37 may be provided and is shown secured to clamp ring 28 by screws 32. This clamp cover is provided for cosmetic purpose only.

Inwardly of the clamped ends of the sleeve 36 is a flexible supporting means for said rotating and rotatable sleeve. A pair of anti-friction bearings 38, each shown and depicted as a ball bearing, with their inner diameters providing a snug fit on the finished exterior diameter of shaft 10. Snap rings 40, as shown, provide lengthwise positioning and retention of bearings 38 on the shaft 10. A metal or plastic sleeve member 42 is carried by these bearings 38 and, as shown, set screws 44 retain this sleeve member 42 on the bearings 38. As depicted, the sleeve 42 is bored a small amount from each end so as to provide a retaining shoulder for said bearings 38.

Figure 7:
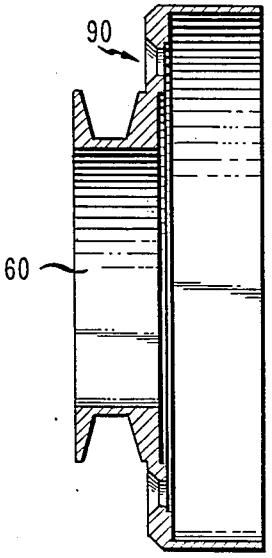
FIG. 7 represents a side view, partly diagrammatic, and showing the end cap with a V-belt sheave.

On this tubular member 42 is carried a multiplicity of disc brushes 48, with bristles extending outwardly from a hub 49 whose inner diameter or bore is sized to be a slideable fit on sleeve 42. Between each brush hub 49 is a spacer 50, conventionally of plastic tubing or molding. These spacers are sized to insure a preferred spacing between brushes 48. Where and when the traveling web is weak and tends to be easily strected, the outer sleeve 36 is driven so that the surface speed is at a determined RPM. When such a requirement is made, a V-belt sheave, identified as 60, is provided with an enlarged hub portion that is drilled and countersunk to accept screws 32, as depicted in FIG. 7. By and with these screws 32, the sheave 60 is attached to the roller and causes it to rotate when the sheave is rotated. The sleeve clamp 34, as provided is a commercially available clamp, similar to a hose clamp and having a flat joining means to minimize any outward protrusion.

USE AND OPERATION

The resilient sleeve 36 is secured to the inner clamp ring 28 by the sleeve clamp 34, during use and operation and is rotated by the traveling web as it is advanced. The non-rotating shaft 10 may be moved in and away from the plane of the web so that the amount of wrap may be increased or decreased as needed. If the roller is dependent on the speed of the traveling web, the anti-friction bearings 26 insure that any drag on the web is minimized. The disc brushes 48 support the resilient sleeve 36 at or near its original diameter. A wrinkle, ripple, bag, torque mark or the like in the web requires an adjustment of the pivoted lever 14. Each end of the spreader roller may have a pivoted lever 14 and adjustment thereof is made to suit the characteristics of the web to be corrected. Where stretch of the web is very small, that side of the web is only stretched a small and sufficient amount by a proper adjustment of the pivoted lever 14. Where and when the wrinkle, ripple, bag, or torque marks are of a greater amount, the pivoted lever 14 is adjusted or tilted a greater amount, with a maximum tilt of 10 degrees. The bristles of the brushes 48 support the resilient sleeve 36 uniformly during the expansion and contraction of the resilient sleeve 36. The bristles provide this support with little to no drag against the inside surface of the resilient sleeve 36 during the rapid expansion and contraction process.

In use, it is to be noted that the pivoted lever 14 is tilted by the adjustment of the extending leg 16 to a selected degree or amount. As the shaft 10 does not rotate but the outer resilient sleeve 36 rotates, the surface speed of this resilient sleeve 36 must be essentially as that of the fast-moving flexible web. Thus, the roller revolves at rather high rpm's. Each revolution requires that this resilient sleeve be and is, stretched and contracted substantially the same amount. The spreading action on the traveling web thus removes the wrinkles, ripples, bags and torque marks. Depending on the amount of adjustment, the traveling web is stretched the desired amount. The wrap and adjustment of the lever(s) 14 establish the spreading extend of the web.

It is to be noted that the bristles of the disc brushes 48, while rotating move longitudinally to accommodate the stretch and contraction of the sleeve 36 and, to a small extent, in and out, with any diametrical change. These brushes may become worn and and require replacement, which is easily accomplished by and with disassembly of the unit from one or both ends. The resilient sleeve 36 may also require replacement and the clamping means 34 described above is employed.

The drawings showing a preferred construction, but alternates may be employed. For example, the shaft support blocks are shown with extending pad portions, conventionally provided with cast blocks, but it is realized that a support block may be constructed in many configurations. This would be a matter of choice. The shaft 10 is shown as tubular, but, of course may be solid. The ends of this shaft may be made with orienting and positioning means such as flats or a keyway. If snap rings 40 are employed, then grooves are formed in the shaft 10, but other means such as lock nuts or collars are contemplated. The shaft 10 is shown as machined or otherwise finished from each end so as to provide inner stop shoulders for a pair of bearings 38, but other shoulder or stop means may be provided such as retaining rings or a tubular sleeve spacer. The pivoted lever 14 may be made as an assembly or from one piece, and the extending leg 16 need to be sufficiently strong to insure that adjustment of ring 18 is positively achieved. It is assumed that bearing 26 carries and retains clamp ring 28. Clamp ring 28 provides the inner retaining means for the resilient sleeve 36. As this resilient sleeve 36 is rather difficult to position on the inner clamp ring 28, a commercially available clamp ring, as described above is employed. But other means such as a banding strap may be employed.

In FIG. 1 is shown the resilient no-bow spreader roller of this invention. This roller, identified as 70, has the resilient sleeve 36 and end caps 37 shown in position. Seen also is the extending lever portions 14 and the adjusting screw 22.

Figure 2:
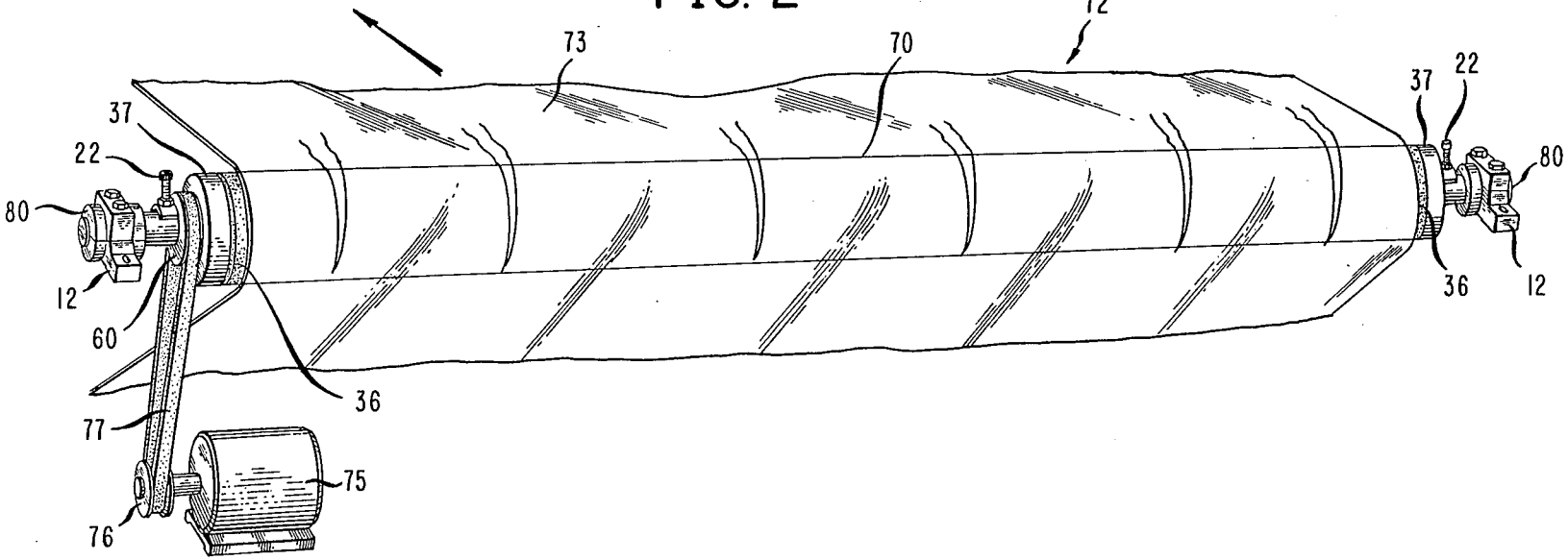
FIG. 2 represents a diagrammatic, perspective view of the no-bow spreader roller, much like the roller of FIG. 1, but with a motor and V-belt drive for rotating this spreader roll when light films or fragile material are presented.

In FIG. 2, the spreader roller is shown as receiving a traveling web of material, identified as 72, and, further showing the material as and when it is smoothed by stretching over and with the roller 70. The exiting material is absent wrinkles, ripples, bags, torque marks and the like. This straightened material is identified as 73. It is to be noted that roller 70 may be rotated at the desired surface speed, where the traveling web does not provide sufficient strength to cause the roller 70 to be rotated without stretching the material. When this condition occurs, a motor 75 has on its output shaft, a V-belt sheave 76 which drives V-belt 77 which in turn drives sheave 60. This auxiliary drive is optional. It is noted in FIG. 2 that the wrap of the web on the roller 70 is less than 180 degrees. The positioning of the pivot lever 14 is at and with any positioning desired by the operator. If and when two pivot levers 14 are used, their pivot axis are in the same plane.

Figure 3:
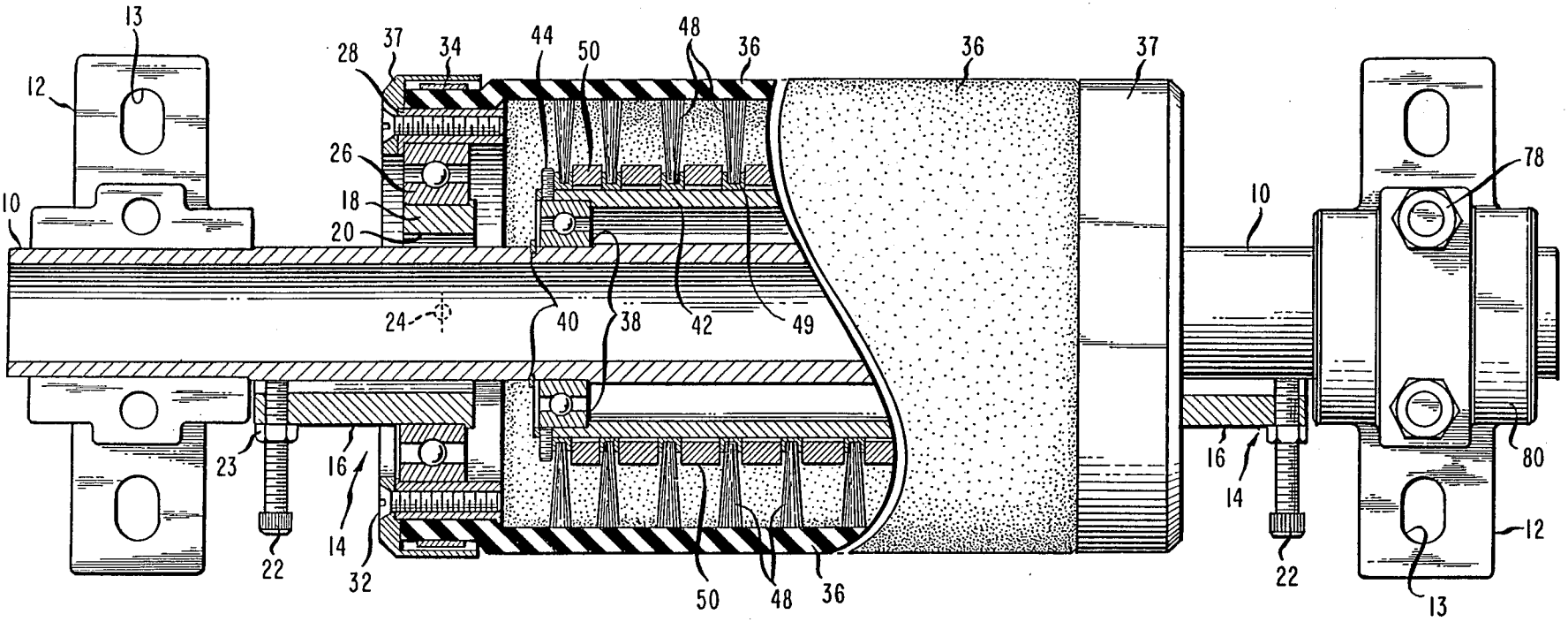
FIG. 3 represents the spreader roll in an enlarged scale from FIG. 1, this view partly in section and partly in a side view, and before tilting of the pivoted levers.

In FIG. 3, the roller is shown in the non-adjusted condition and with the pivot levers 14 toward the bottom of the view, but this is merely for convenience of illustration. The support blocks 12 are conventional and commercial, employing bolts 78 and a cap member 80 (FIGS. 2, 3 and 4).

Figure 4:
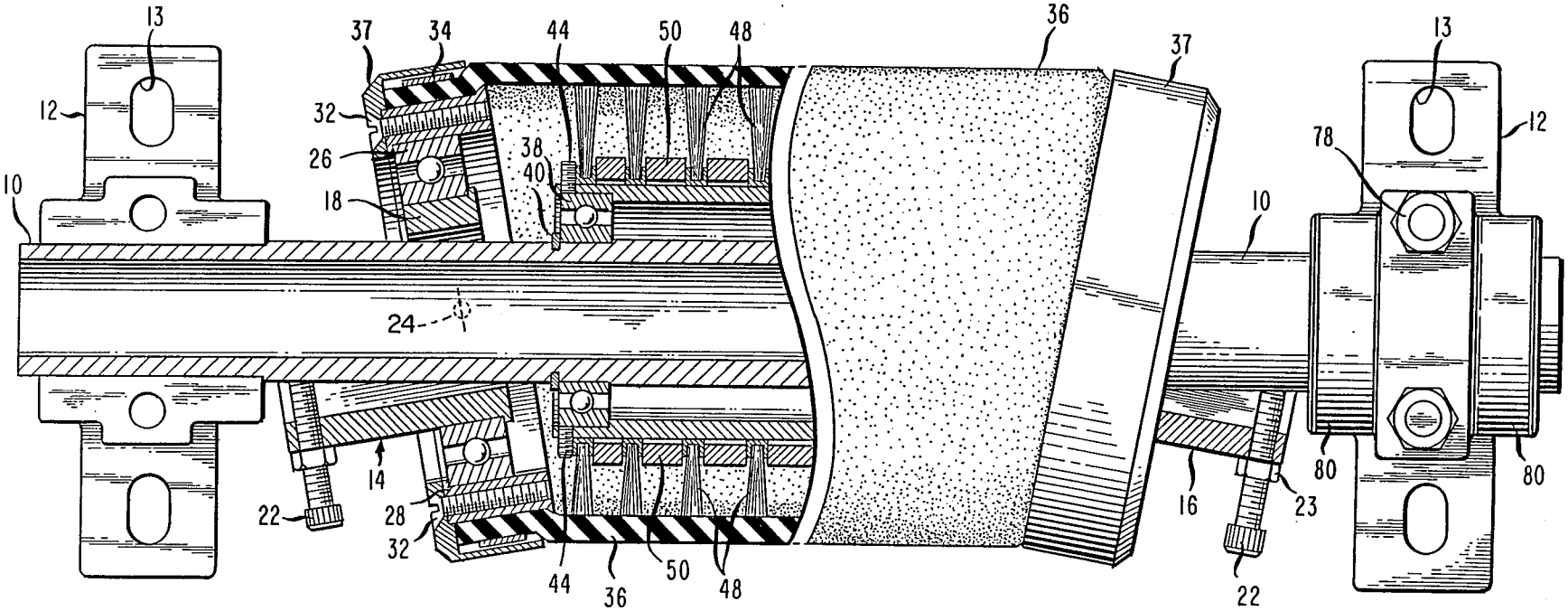
FIG. 4 represents the view of FIG. 3, but with the pivoted levers actuated to stretch the outer resilient member portion of the spreader roll.

In FIG. 4, the spreader roll is shown with the pivot adjustment lever in a, more or less, out position. It is to be realized that the pivot actuation is diametrically opposite the desired stretch of the outer resilient sleeve 36. This view shows the maximum tilt produced by the pivot mechanism, but adjustment of each end is made to suit the conditions of the traveling web. For instance, one end of the sleeve of the spreader roll 70 may use little or no expansion and the other end of the roll may require the maximum expansion, so the adjustment of the pivot lever mechanism is made to accommodate the needs of the webs as far as wrinkles thereof. The amount of stretch applied to the resilient member 36 also reflects in the stretch of the traveling web 72 in its corrected condition shown as 73 in FIG. 2.

Figure 5:
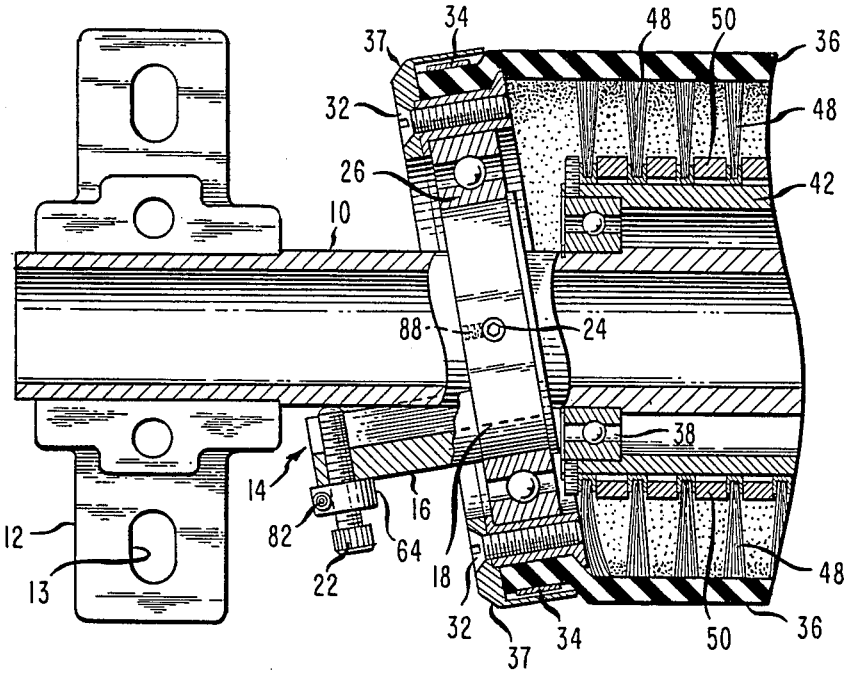
FIG. 5 represents a fragmentary side view of the lever extension of the pivot lever and showing a stop collar mounted on the threaded shank of the screw providing the adjustment, this stop collar providing a resettable limiting stop.

In FIG. 5, the pivot mechanism is shown with the leg 16 adjusted to produce a maximum tilt, more or less, for the adjustment depicted in FIG. 4. The traveling web or webs may require a repeated adjustment, so there is depicted a stop collar 64 which is formed with threads to mate with the threaded shank of screw 22 (FIG. 3). A screw 82 tightens the stop collar 64 at the desired position. Loosening and tightening the screw 82 allows the stop collar 64 to be rotated on the threaded shank of adjusting screw 22. This stop collar 64 may be used in place of hex nut 23 seen in FIG. 3.

Figure 6:
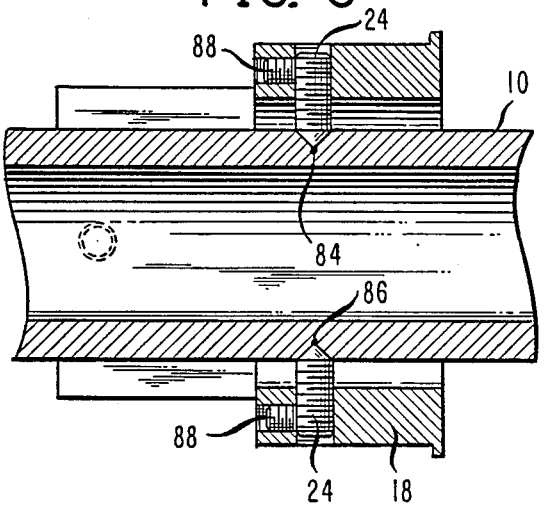
FIG. 6 represents a fragmentary end view showing the inner ring portion of the pivot member and showing two pivot pins extending into receiving apertures in the rigid shaft, and depicting a typical lock screw to retain each pivot pin.

In FIG. 6, the tubular shaft 10 is seen with the bearing ring portion 18 of the pivot apparatus seen. The pivot means is merely a matter of selection, but one method is shown. In bearing ring 18 are formed threaded apertures in which threaded pivot screws 24 are mounted. These screws have their inward ends tapered into a point 84 to provide pivot retention. These screws are conventionally machined or otherwise formed to the desired configuration. Two tapered or V-shaped recesses are provided in each end portion of the shaft 10. These recesses are identified as 86. These screws 24 are retained by and in said mating recesses 86 in shaft 10. The pivot screws 24 may be prevented from loosening by many means, such lock set screws 88 mounted in threaded holes formed in said bearing ring 18. It is essential that the pivot lever be easily and positively adjusted by an operator. The point 84 on the screws 24 allows adjustment for tightening and loosening screws so that the pivoting means may be at the friction or tightness. This adjustment also allows the manufacturer of the spreader roller to compensate for any eccentricity of the bearing ring 18 to the shaft 10. Each screw is adjusted to obtain a substantially concentric arrangment of the bearing ring 18 to the shaft 10. The bearing ring 18, the positioning of the screws 24 and the V-shaped recesses 86 are a preferred method, but other pivot-retaining methods and apparatus may be utilized.

In FIG. 7, the V-belt driven sheave 60 is depicted. This sheave may be secured to an end cap 37 as by welding, adhesive and the like, or the end cap and sheave may be unitarily produced as by casting or machining from bar stock. The sheave 60 is contemplated to be configured to accommodate both A and B belts, but other sizes as well as toothed belts may be utilized. This showing in FIG. 7 pertains to the use of the spreader roller 70 where the traveling web 72 does not have the strength to drive the roller without additionally stretching or affecting the web of material. The use of a sheave 60, driven by the V-belt 77, sheave 76 and motor 75 provides the needed assistance in rotating the roll at the desired peripheral speed without altering the longitudinal characteristics of the traveling web. This assistance is particularly useful where thin films, foils and the like are involved. As illustrated, this end cap 90 with the V-belt sheave 60 is attached to clamp ring 28 by means of screws 32. As the tilt of the adjusted pivot is usually ten degrees or less, a twist in the V-belt 77 is easily accommodated.

When and if adjustment of the lever arm 14 is to be positioned repeatedly, a collar stop 64 may be used on the threaded shank of screw 22. The tubular member 42 is shown with machined ends providing shouldered bores for receiving and positioning the outer races of bearings 38, but other means may be provided. The pivot screw 24 may be a bolt through the shaft 10 and ring 18 or may be headless set screws in threaded apertures of the ring and into formed holes in the shaft 10. In any embodiment, the pivots are substantially in alignment so that the pivot action does not cause the resilient outer roller sleeve to be slightly skewed or twisted. It is to be noted that a pivot pin as a headless set screw, with a turned-down inner end, and a lock screw from the side of the ring may be provided. As the shaft 10 does not turn, the pivot axis is normal to the desired spreading actuation.

This spread roller is particularly adapted for use in metalized films, foils and the like. These range from a no-compensating adjustment to a large adjustment. As noted above, bowed and grooved rollers stretch the center of the traveling web and do not adjustably provide a selective stretch of the web. For example, one edge portion of the customer's web may not require or desire any stretching, and the other edge portion may require dramatic spreading. The wrap of the web on the roller is also utilized in the arrangement of the apparatus. The straight roller of this invention provides a selective adjustment of this roller, enabling the web converter to overcome the many problems caused by across-the-web profile unevenness. The length of the no-bow spreader roller is made to accommodate the customer's production line, due to its modular construction.

In its construction and use, the no-bow spreader roll depicted and described above is believed to provide the basis of a method of such construction and use. This method includes the steps of:

providing a rigid, non-rotating, substantially straight shaft;

mounting and positioning at least one pivot lever which is fixedly secured to a ring member, said member having an extending leg portion, and pivotally carrying this lever member by said shaft, and selectively and adjustably tilting said ring member from the axis of said shaft by the operator of the equipment;

providing means carried by the leg portion, said means having engaging means so that the ring member is moved to a selective tilt, and forming a bore in this ring member sufficient to allow the tilt absent interference with the shaft;

carrying a first anti-friction bearing by each ring member;

securing and carrying an inner clamp ring member by said first anti-friction bearing;

supplying a resilient outer tubular sleeve as the outer roller member, this sleeve of a selected thickness and length, and having a relatively smooth interior diameter;

clamping each end of the resilient tubular sleeve to said inner clamp ring member during spreading and contraction of said sleeve;

carrying a rotatable tubular support member by second and third anti-friction bearings whose inner diameter portions are secured to the rigid shaft at a desired location;

supplying and positioning a multiplicity of disc-type brushes so that the bristles extend outwardly from a retainer ring or hub whose inner diameter is slideable on the outer surface of said tubular support member, and with said bristles providing support for the resilient tubular sleeve as said bristles engage the inner surface of said outer tubular sleeve;

arraying a multiplicity of spacers between the disc-type brushes and positioning said spacers so as to engage the side extents of the retainer rings of the brushes, and retaining said brush hubs by and with spacer means and with the spacers in a desired array on said tubular support member, adjusting each pivot level to a desired tilted condition to provide the desired spreader actuation of the resilient tubular sleeve, the freely rotating tubular sleeve of the roller is lengthened and contracted with each revolution, with the bristles of the brushes assisting in supporting said resilient tubular member.

Terms such as "left," "right," "up," "down," "bottom," "top," "front," "back," "in," "out" and the like are applicable to the embodiment shown and described in conjunction with the drawings. These terms are merely for the purposes of description and do not necessarily apply to the position in which the spreader roll for wrinkle-free traveling web may be constructed or used.

While this particular embodiment of the spreader roll for wrinkle-free traveling web has been shown and described, it is to be understood that the invention is not limited thereto and protection is sought to the broadest extent the prior art allows.

What is claimed is:

1. A no-bow spreader roll for removing wrinkles, ripples, bags and torque marks from fast-moving webs of material such as fabric, foil, plastic film and/or combinations thereof, said spreader roll including:

(a) a rigid, non-rotating, substantially straight shaft;

(b) a plurality of pivot lever members, each pivot lever member having a ring member and an extending leg portion, each pivot lever member pivotly carried by and at opposite ends of said shaft and each pivot lever member selectively and adjustably tiltable from the axis of said shaft by an operator of the equipment;

(c) means carried by each leg portion having engaging means so that the ring member is moved to a selective tilt, and a bore in this ring member is sufficient to allow the tilt absent interference with the shaft;

(d) a first anti-friction bearing carried by each ring member;

(e) an inner clamp ring member secured to and carried by each said first anti-friction bearing;

(f) a resilient outer tubular sleeve providing the outer roll member, this resilient tubular sleeve of a selected thickness and length, and having a relatively smooth surface on its inner diameter;

(g) means for clamping each end of the resilient tubular sleeve to each inner clamp ring member so that said tubular sleeve is retained to and on each inner clamp ring member during lengthening and contraction of said resilient tubular sleeve;

(h) a rotatable tubular support member carried by second and third anti-friction bearings, inner diameter portions of said second and third anti-friction bearings are secured to the rigid shaft at desired locations;

(i) a multiplicity of disc-type brushes, each of said disc-type brushes having bristles extending outwardly from a hub whose inner diameter is slideable on the outer surface of said tubular support member, and with said bristles providing support for the resilient tubular sleeve as said bristles engage the inner surface of said outer resilient tubular sleeve;

(j) a multiplicity of spacers arrayed between each pair of the disc-type brushes and positioned so as to engage the side extents of each hub of each pair of disc-type brushes, and (k) means to retain the multiplicity of brushes and spacers in a desired array on said tubular support member, and as the pivot level member is adjusted to a desired tilted condition to provide the desired spreader action of the resilient tubular sleeve, the freely rotating resilient tubular sleeve of the roller being caused to lengthen and contract with each revolution, with the bristles of each of the disc-type brushes assisting in supporting said resilient tubular sleeve member.

2. A no-bow spreader roll as in claim 1 in which the rigid shaft is retained and supported at each end by a support block having a support surface and mounting means for fixed retention.

3. A no-bow spreader roll as in claim 1 in which each ring member on each pivot lever member carries a ball bearing in a secured and precise condition, each ball bearing providing the first anti-friction bearing.

4. A no-bow spreader roller as in claim 3 in which a threaded screw provides the tilt adjustment of the ring member of each pivot lever member.

5. A no-bow spreader roller as in claim 4 in which the threaded screw also includes an adjustable stop carried on its threaded shank.

6. A no-bow spreader roll as in claim 3 in which each pivot lever member has the pivot provided by pin means extending from each side of the ring member of the pivot lever member, said pins having threads so as to extend into formed apertures in the fixed shaft, these pivot actuations in a determined and substantially the same plane alignment which passes through the axis of the rigid shaft.

7. A no-bow spreader roll as in claim 3 in which, each of said inner clamp ring member is contoured to provide a stop shoulder for said first anti-friction bearing, and said inner clamp ring member having a clamp shoulder on an inward extent of its outer diametrical surface.

8. A no-bow spreader roll as in claim 7 in which each inner clamp ring member is also provided with a plurality of threaded apertures.

9. A no-bow spreader roll as in claim 6 in which there is additionally provided for each end an end cap having a plurality of holes adapted to mate with the threaded apertures in the inner clamp ring member, each end cap secured to the inner clamp ring member by screws passing through the holes in the end cap and into the threaded apertures in the inner clamp ring member.

10. A no-bow spreader roll as in claim 9 in which one of the end caps is provided with a V-belt sheave adapted to receive and retain a V-belt which is driven at a selected speed by motor means so that the fast-moving web of material is not unduly stressed as it is advanced.

11. A no-bow spreader roll as in claim 7 in which the means for clamping each end of the resilient outer tubular sleeve to each inner clamp ring member is a preformed sleeve clamp which co-acts with the clamp shoulder of the inner clamp ring member to retain the resilient outer tubular sleeve during said lengthing and contraction.

12. A no-bow spreader roll as in claim 1 in which the second and third anti-friction bearings secured to the shaft are ball bearings.

13. A no-bow spreader roll as in claim 12 in which the second and third ball bearings have their inner races secured by inner stop shoulders formed on the shaft and with snap rings mounted in mating grooves precisely ositioned and formed in said shaft, and with these second and third ball bearings having their outer races adapted to carry said tubular support member, shoulder stops on said tubular support member, with the inward longitudinal limit of said second and third ball bearings established by said shoulder stops and stop shoulders, and meant to secure the tubular support member to the outer races of said bearings.

14. A no-bow spreader roll as in claim 13 in which each shoulder stop in the tubular support member is a formed recess in each end of the tubular support member, and the means for securing said tubular support member to the outer races of the bearings is at least one set screw mounted in a threaded hole in said tubular support member.

15. A no-bow spreader roll as in claim 1 in which the disc-type brushes are spaced about one-half inch apart, and with the disc-type brushes about one-quarter inch in thickness.

16. A no-bow spreader roll as in claim 15 in which the spacers are of plastic tubing cut to a desired length.

17. A no-bow spreader roll as in claim 15 in which the disc-type brushes have about three-quarters of an inch extension from the hub and provide sufficient flexing during rotation of the roller.

* * * * *